United States Patent [19]

Reynolds

[11] Patent Number: 4,656,802

[45] Date of Patent: Apr. 14, 1987

[54] VENT PIPES FOR CINDER BLOCK WALLS

[76] Inventor: Lawrence E. Reynolds, 1093 Eden Cir., Spring Hill, Fla. 33526

[21] Appl. No.: 831,800

[22] Filed: Feb. 21, 1986

[51] Int. Cl.[4] ..... E04B 1/70; E04F 17/04

[52] U.S. Cl. ..... 52/300; 52/98; 52/199; 52/303

[58] Field of Search ..... 52/199, 219, 303, 305, 52/300, 98; 285/42

[56] References Cited

U.S. PATENT DOCUMENTS

| | | | |
|---|---|---|---|
| 964,942 | 7/1910 | Smith | 52/303 |
| 2,007,689 | 7/1935 | Merrill | 52/303 |
| 2,931,215 | 4/1960 | Rose | 52/303 |
| 3,579,930 | 5/1971 | Murphy | 52/219 |
| 4,372,585 | 2/1983 | Evora | 52/219 |

*Primary Examiner*—Alfred C. Perham

*Attorney, Agent, or Firm*—Stanley M. Miller

[57] ABSTRACT

Heat escape pipes for cinder block structures. A cinder block cavity cap is modified to have a central aperture formed therein. The aperture is specifically configured and dimensioned to receive the base of an upstanding vent pipe. The modified cavity caps are installed in the conventional manner, i.e., they are positioned to cap the cinder blocks in the penultimate row of blocks. The vent pipes are of sufficient length to extend above the concrete which is thereafter poured into the void of the top row of blocks, which concrete is prevented from entering the voids in the blocks below the top row by the cavity caps. Hot air escapes through the vent pipes since the respective lowermost ends of the pipes extend through the respective apertures formed in the cavity caps to thereby provide communication between the interior of the wall and the exterior of the wall.

7 Claims, 4 Drawing Figures

VENT PIPES FOR CINDER BLOCK WALLS

BACKGROUND OF THE INVENTION

1. Field of the Invention

This invention relates to the field of building construction, cinder block building structures in particular, and more specifically it relates to means for removing heat from the interiors of cinder block walls.

2. Description of the Prior Art

U.S. Pat. No. 346,734 to Daniels (1886) shows a building block having openings formed in the interior thereof.

A 1914 patent to Crane (U.S. Pat. No. 1,087,644) shows a flat reinforced concrete construction having elongate openings formed therein.

An orifice forming core having utility in concrete floor construction is shown in U.S. Pat. No. 1,603,245 to Pederson (1926).

Pipes into which may be pumped cold or hot air are embedded in the building blocks shown in U.S. Pat. No. 1,745,765 to Lucas (1930).

D. D. Downing, in U.S. Pat. No. 3,391,507 (1968), shows a building block construction having embedded pipes into which may be placed electrical wires or gaseous fluids for heating and cooling the structure formed by the blocks.

Another embedded pipe system is shown in U.S. Pat. No. 4,257,481 to Dobson (1981).

It is clear that the art has addressed the problem of how to cool walls in order to increase the comfort of the occupants of the buildings formed by such walls. The solution that the art has come up with involves embedding pipes in the walls to be cooled, and pumping cold fluids therethrough.

Although this approach is workable, it is an expensive solution to the problem. The solution to the problem increases the cost of the building's construction since building blocks with pipes embedded therein are considerably more expensive than conventional building blocks. Moreover, the energy required to pump cool fluids through the embedded pipes is not free; thus, the cost of maintaining such a building can be high.

There is a need for a building construction that provides an economical way of cooling building walls. The ideal invention would render the walls cooler in the absence of the expenditure of energy, i.e., the ideal system would be passive and would require no operating costs.

The art contains no teachings or suggestions on how to fulfill the need that exists.

SUMMARY OF THE INVENTION

The invention has utility in connection with structures constructed of cinder blocks. Such blocks are hollow and hot air within a block can rise and escape therefrom if an escape route is provided.

However, in conventional construction, no escape route is provided; accordingly, the art has embedded pipes in cinder blocks so that cool fluids can be pumped therethrough, as aforesaid.

In cinder block construction, walls are built up from a foundation by laying one row of blocks at a time. Each succeeding row of blocks surmounts the row laid before it, in staggered relation as is well known. When the top row has been laid, concrete is poured on top of it to complete the wall; of course, in the absence of a means to prevent the poured concrete from filling the entire wall, large amounts of concrete would be wasted in filling all the voids in the wall. Accordingly, the art employs a capping means known as a cinder block cavity cap cover; a cover is placed on the top of each block of the penultimate row of cinderblocks and then the concrete is poured. Thus, the only voids filled with concrete are the voids of the uppermost row of blocks. The use of cavity cap covers is well known. They are imperforate, however, and their use serves to trap heat within the voids of the blocks that form the capped wall.

The present invention includes a modification to the conventional cavity cap cover; a central aperture is provided therein. An upstanding vent pipe having a base adapted to fit through the opening is then joined to the cover. The resulting structure is a cavity cap cover having an upstanding vent pipe positioned centrally thereof. The novel structure is installed in the normal fashion by placing it in capping relation to the penultimate row of blocks before the concrete is poured to cap the wall.

The length of the respective novel vent pipes is preselected so that the distal free ends thereof will project upwardly out of the concrete after the concrete has been poured. Thus, hot air within the cinder blocks may escape from the confines of the wall through the vent pipes. To obtain maximum cooling, every cavity cap cover used in construction should be of the novel variety. Where smaller amounts of cooling are desired, fewer vented cavity cap covers would be employed.

The primary object of this invention is to reduce building cooling costs by the provision of a passive cooling system that consumes no energy as it operates.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, refernce should be made to the following detailed description, taken in connection with the accompanying drawings, in which.

Similar reference numerals refer to similar parts throughout the several views of the drawings.

DETAILED DESCRIPTION OF THE PRIOR ART

Figure 1:
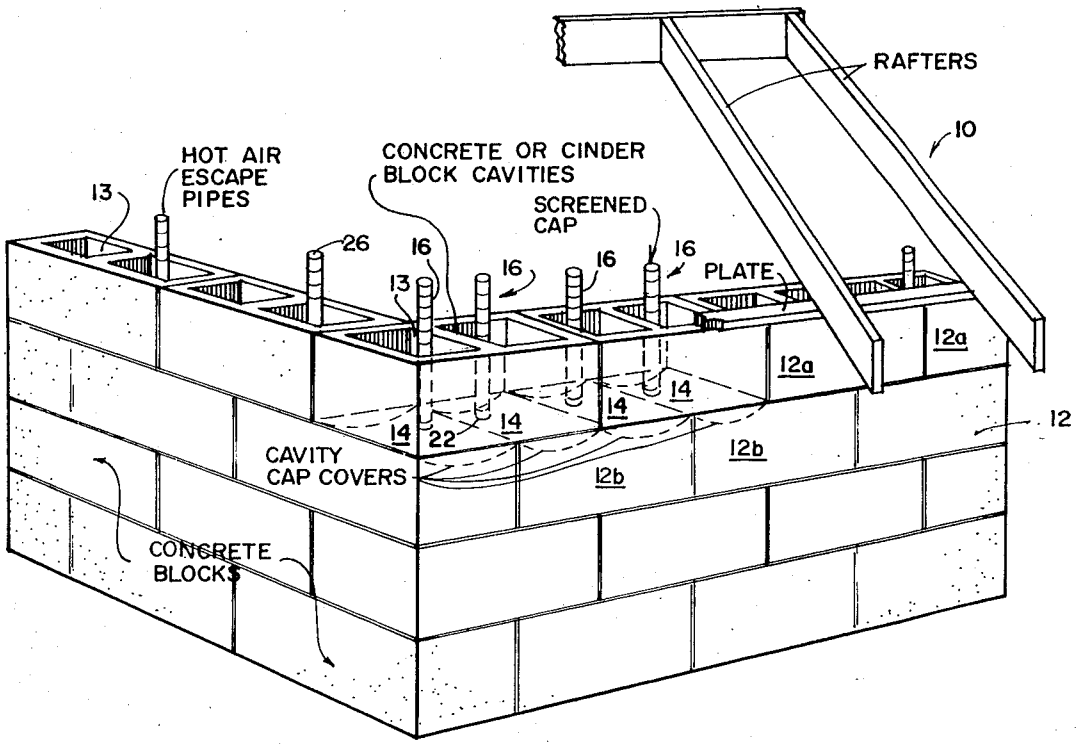
FIG. 1 is a perspective view of a cinder block building provided with the novel cavity capping means; the drawing shows the wall construction before the concrete that caps the wall is poured.

Referring now to FIG. 1, it will there be seen that a cinder block building is designated by the reference numeral 10 as a whole.

The cinder blocks in FIG. 1 are generally designated 12; the cinder blocks in the uppermost row are collectively designated **12*a* and the blocks in the penultimate row of the respective walls are collectively designated 12*b*; the modified cavity cap covers which are an important structural feature of this invention are collectively designated 14, and the upstanding vent pipes are collectively designated 16**.

It will be noted from an inspection of FIG. 1 that the height of the vent pipes 16 is sufficient to enable them to extend upwardly of the blocks 12*a;* when concrete is poured into the cavities of the blocks 12*a,* as indicated by the directional arrow 13, the distal free ends of pipes 16 must extend thereabove or the escape means provided by the pipes 16 would be lost.

Figure 2:
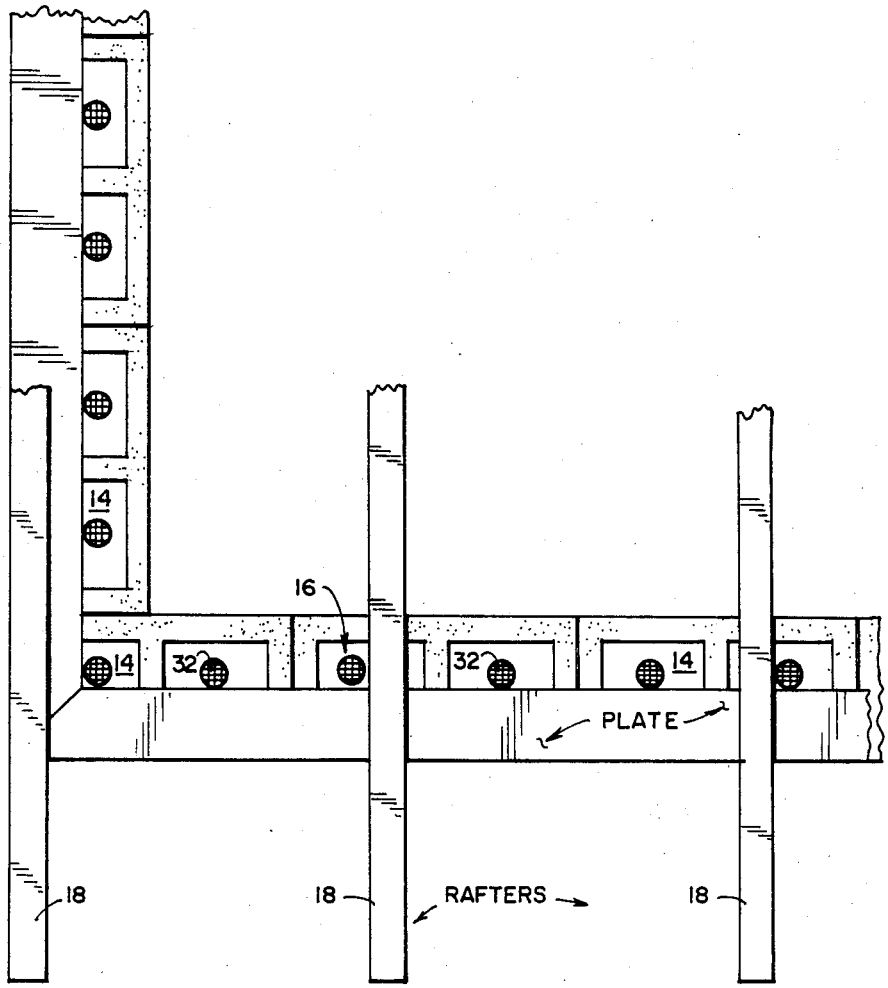
FIG. 2 is a top plan view of a wall provided with the novel cavity caps.

FIG. 2 shows the proper positioning of pipes 16; they must be spaced away from rafters 18.

Figure 3:
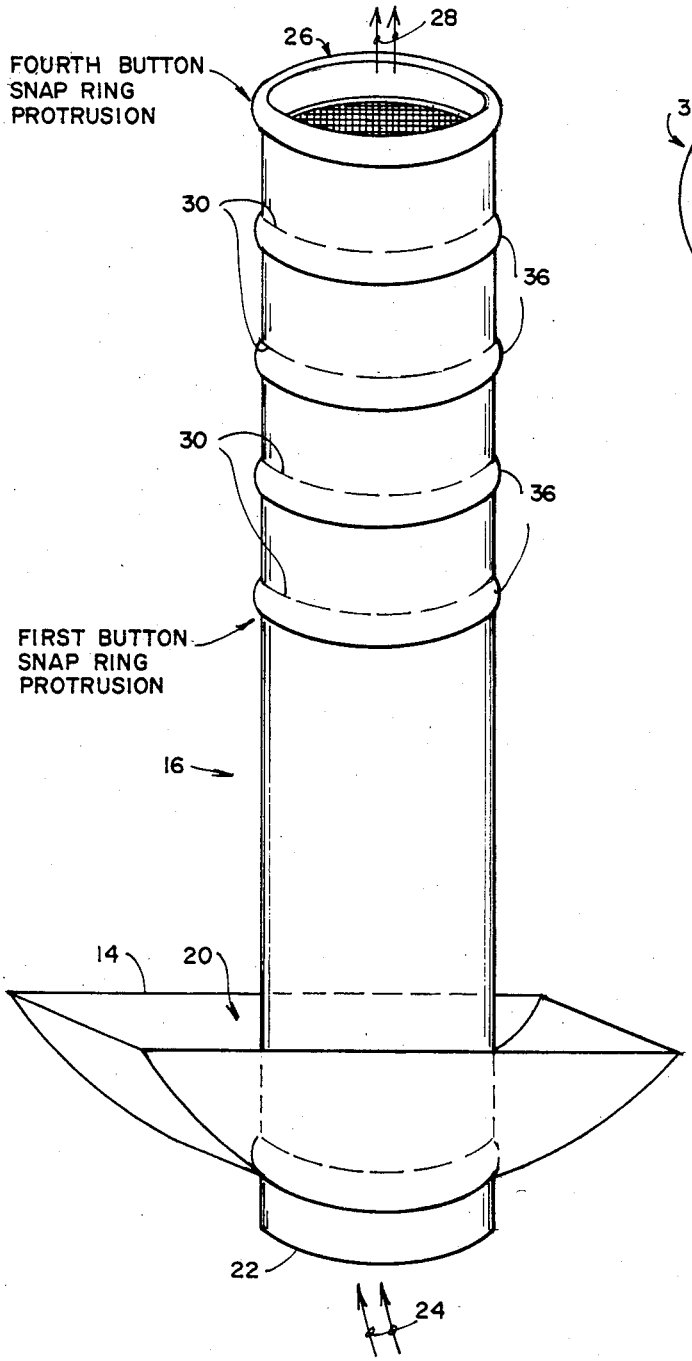
FIG. 3 is a side elevational view of the novel cavity cap cover.

The structural details of the novel device are best shown in FIG. 3. It will there be seen that the base 20 of pipe 16 extends through and engages an aperture formed centrally of cavity cap cover 14. Opening 22 at the base of pipe 16 cannot be closed by concrete because it is positioned below the plane of cavity cap cover 14. Accordingly, hot air may enter pipe 16 as indicated by directional arrows 24 and escape therefrom through opening 26 at the top of pipe 16 as indicated by directional arrows 28.

In order to provide flexibility or universality, pipe 16 is constructed in segments as shown in FIG. 3. A plurality of vertically spaced cut lines, collectively designated 30, are formed in pipe 16 so that portions thereof extending above the poured concrete can be easily removed.

Figure 4:
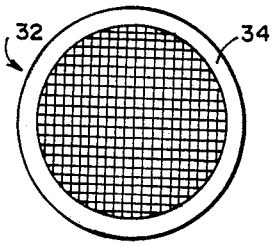
FIG. 4 is a plan view of a screen member used in conjunction with the novel cavity cap cover.

FIG. 4 shows a screen member 32 that is inserted into each pipe 16 to keep debris from blocking the pipe's internal passageway. The annular periphery 34 of screen 32 is resilient and will fit into the pipe 16 at any one of the annular grooves 36 formed therein to receive the same; note that the cut lines 30 are just above each annular groove 36 and that screen 32 will always be placed into position in the uppermost groove remaining after a cut has been made.

Since pipes are inexpensive, and since it is a simple matter to form apertures in cavity cover caps, the inventive structure can be mass produced at low cost. Accordingly, its use will add only a nominal amount to the building's initial cost, and will add nothing at all to the operating cost of the building due to its passive design.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device that cools cinder block walls by allowing heat within the walls to escape into the atmosphere, comprising:

a cavity cap cover member of the type designed as a capping means for cinder blocks, there being as many cavity cap covers per cinder block as there are cavities formed in said cinder block;

an aperture formed in said cavity cap cover member;

an upstanding vent pipe having a preselected length and a base;

said base of said vent pipe specifically configured and dimensioned to securely engage the periphery of said aperture so that when said base is engaged by said aperture, said vent pipe is held firmly in an upstanding disposition and so that concrete poured upon said cavity cap cover member can not leak through the aperture.

2. The device of claim 1, wherein the height of the vent pipe is greater than the height of a cinder block.

3. The device of claim 2, wherein the vent pipe has a cylindrical configuration and has a plurality of vertically spaced, horizontally disposed annular grooves formed in its cylindrical sidewall.

4. The device of claim 3, further comprising a flat, circular screen member adapted to be press fit into a preselected annular groove.

5. The device of claim 4, further comprising a plurality of vertically spaced apart, horizontally disposed parting lines formed in said vent pipe which enable cutting of a vent pipe so that its height is adjustable.

6. The device of claim 5, wherein each of said cutting lines is positioned just above an associated annular groove so that a screen member may be positioned into the uppermost annular groove remaining after a vent pipe has been cut.

7. The device of claim 2, wherein the cavity cap cover member is centrally apertured.

* * * * *